US008481928B2

(12) United States Patent
Franzen

(10) Patent No.: US 8,481,928 B2
(45) Date of Patent: Jul. 9, 2013

(54) INTRODUCTION OF IONS INTO MASS SPECTROMETERS THROUGH LAVAL NOZZLES

(75) Inventor: Jochen Franzen, Bremen (DE)

(73) Assignee: Bruker Daltonik, GmbH, Bremen (DE)

( * ) Notice: Subject to any disclaimer, the term of this patent is extended or adjusted under 35 U.S.C. 154(b) by 0 days.

(21) Appl. No.: 12/862,299

(22) Filed: Aug. 24, 2010

(65) Prior Publication Data

US 2011/0036978 A1 Feb. 17, 2011

(30) Foreign Application Priority Data

Aug. 28, 2009 (DE) ..... 10 2009 039 032
Sep. 16, 2009 (DE) ..... 10 2009 050 040

(51) Int. Cl.
*H01J 49/26* (2006.01)

(52) U.S. Cl.
USPC ..... 250/288; 250/281; 250/282

(58) Field of Classification Search
USPC ..... 250/281, 282, 283, 288
See application file for complete search history.

(56) References Cited

U.S. PATENT DOCUMENTS 6,630,665 B2 10/2003 Tanner et al.
2004/0011955 A1 1/2004 Hirano et al.
2009/0212210 A1* 8/2009 Finlay et al. ..... 250/288
2009/0242755 A1* 10/2009 Tang et al. ..... 250/288
2010/0090102 A1 4/2010 Rather et al.

FOREIGN PATENT DOCUMENTS

DE 2650685 A1 5/1978
GB 816681 7/1959
GB 2457708 A1 8/2009

OTHER PUBLICATIONS

Kim, et al., "Improved Ion Transmission From Atmospheric Pressure to High Vacuum Using a Multicapillary Inlet and Electrodynamic Ion Funnel Interface", Anal. Chem., vol. 72, No. 20, pp. 5014-5019, Oct. 15, 2000.
Lin, et al., "Ion Transport by Viscous Gas Flow Through Capillaries", J Am Soc Mass Spectrometry, 1994, 5, 873-885.
Prior, et al., "Improved Capillary Inlet Tube Interface for Mass Spectrometry—Aerodynamic Effects to Improve Ion Transmission", Computing and Information Sciences Annual Report, 1999.

* cited by examiner

*Primary Examiner* — Nicole Ippolito
(74) *Attorney, Agent, or Firm* — ROBIC, LLP

(57) ABSTRACT

Ions entrained in a gas are transported into the vacuum system of an ion user, such as a mass spectrometer, from an ion source located outside the vacuum. The gas and ions pass through a nozzle that connects the ion source to the vacuum system and is shaped to form a supersonic gas jet in a first vacuum chamber of the vacuum system. In the first vacuum chamber, ions entrained in the supersonic gas jet are extracted electrically or magnetically and are collected, for example, by an RF ion funnel and transmitted to the ion user. The supersonic gas jet travels on and, after passing through the first vacuum chamber, the supersonic gas jet is directed into a separate pump chamber out of which the gas is pumped.

12 Claims, 3 Drawing Sheets

INTRODUCTION OF IONS INTO MASS SPECTROMETERS THROUGH LAVAL NOZZLES

BACKGROUND

The invention relates to methods and devices for the gas-assisted transport of ions from an ion source outside the vacuum into the vacuum system of an ion user, such as a mass spectrometer. In modern mass spectrometers the ions are often generated at atmospheric pressure (API=atmospheric pressure ionization) outside the mass spectrometer. The best known and most prevalent source of this kind is the electrospray ion source (ESI), which can mainly be used for polar substances such as proteins, but ion sources using chemical ionization at atmospheric pressure (APCI) or photoionization at atmospheric pressure (APPI) are increasingly used. Laser ionization of gaseous molecules at atmospheric pressure (APLI) was added recently, and matrix-assisted laser ionization of solid samples on sample supports can also be performed at atmospheric pressure (AP-MALDI).

In mass spectrometers with atmospheric pressure ion sources, the ions first have to be transferred into the vacuum and then transported to the mass analyzer through a number of differential pump stages. Very efficient systems such as RF ion funnels and RF ion guides are available to transport the ions within the vacuum system, but they only work well in vacua at pressures below a few hectopascal. To transfer the ions from atmospheric pressure into the vacuum system of the mass spectrometer, many commercial mass spectrometers nowadays use long inlet capillaries which introduce the gas directly into the first stage of the vacuum system, following the invention of the Nobel Laureate John B. Fenn and his colleagues. If one considers the transport efficiency along the whole transport path of the ions from their generation in the ion source to the analysis in the ion analyzer, however, the inlet capillary is the weakest link in the chain by far. Firstly, the inlet capillary limits the amount of gas introduced, and thus also the quantity of ions introduced with the gas; secondly, the transport of the ions through the inlet capillary is associated with an ion loss of 80 to 90 percent.

Other commercial mass spectrometers use conical apertures, which do not usually lead directly into the first vacuum stage, but initially into a prevacuum stage. One example is the Z-Spray™ from Waters, (S. Bajic, U.S. Pat. No. 5,756,994), which represents such a dual-step introduction of the ions via two successive, conical entrance orifices positioned perpendicularly to each other with appropriately applied electric suction voltages. From the prevacuum stage the ions are transferred through the second conical orifice into the first vacuum stage of the mass spectrometer. The sensitivity of these mass spectrometers is no higher than that of the mass spectrometers with inlet capillaries, however, and one must therefore assume that high ion losses occur here, too.

In air or other gases, ions can survive for any length of time if their ionization energy is less than the ionization energy of the ambient gas molecules, if neither ions of the opposite polarity nor electrons are available for recombination, and if no collisions with walls can take place which would regularly discharge the ions and thus destroy them as ions.

Ions can be transported through gases by means of electric fields, in which case the laws of ion mobility apply, according to which the ions move at a relatively slow speed along the electric lines of force, being continuously retarded by friction with the gas and their direction being only slightly affected by diffusion. It is, however, also possible to transport the ions by means of the moving ambient gas itself if the ambient gas has a pressure at which the ions can be viscously entrained. If ion-containing gas is pressed through a tube or capillary, for example, ions are entrained in the gas and transported through the tube or capillary. The best known example is the above-mentioned inlet capillary into the vacuum of a mass spectrometer.

It is known from capillary chromatography that all molecules of a gas moving through a capillary suffer an extraordinarily high number of wall collisions. The number of wall collisions essentially corresponds to the number of theoretical (vaporization) plates which represent the separation efficiency of chromatographic columns. In capillary columns this is extremely high. A rough rule of thumb for an optimal gas velocity (the "van Deemter velocity") is that a molecule statistically collides once with the wall after a path which corresponds to the diameter of the capillary. For higher gas speeds, the number of wall collisions per unit of path length decreases. Time and again, however, a molecule under consideration covers long paths with no wall collisions interspersed with paths with much more frequent wall collisions. It follows that only those ions which happen to cover a long path without coming into contact with the wall can get through a capillary undamaged. It may be assumed that these ions have entered the capillary roughly in the center.

The phenomenon of ion transport in capillaries was investigated in the paper "Ion Transport by Viscous Gas Flow through Capillaries" by B. Lin and J. Sunner in J. Amer. Soc. Mass Spectr. 5, 873 (1994). The authors first refuted the widely held view that the ions can be pushed to the center of the capillary by applying a charge to the capillary walls. Inside a capillary with uniformly charged walls there is a field-free drift region with no focusing properties. The ions experience no repulsion whatsoever when they approach the charged wall. The authors' experiments showed that the diffusion of the ions toward the walls does indeed cause high losses to the extent which was theoretically to be expected and that, as was statistically to be expected, only a residual number of the ions can pass undamaged through the capillary. The relative yield of transported ions decreases with the length of the capillary, and there is a similar drastic reduction for thinner capillaries. A further loss occurs because of space charge effects at high ion density; the Coulomb repulsion drives the ions to the capillary walls. The space charge effects limit the absolute yield of ions during transport through such inlet capillaries.

The paper "Improved Ion Transmission from Atmospheric Pressure to High Vacuum Using a Multicapillary Inlet and Electrodynamic Ion Funnel Interface" by T. Kim et al., Anal. Chem, 72, 5014-5019 (2000) describes how a bundle of seven similar metal capillaries, soldered into a block, can achieve much more than seven times the ion transport of a single metal capillary with similar dimension, although the seven capillaries have to be equipped with a more powerful pump system in order to achieve roughly the same pressure in a downstream ion funnel. How the bundle of seven capillaries achieves the 10- to 20-fold ion transport is still unexplained. Nor is there an explanation as yet as to how two different bundles whose individual capillaries have inside diameters of 0.51 and 0.43 millimeters respectively, whose gas streams must differ mathematically by a factor of two in accordance with Hagen-Poiseuille, demonstrated a reduction of the ion transport of only 30 percent.

It can only be surmised that mutual influencing of the gas streams means that the inflow of the ions into the seven adjacent capillaries of the bundle is more organized than the inflow into a single capillary, and possibly leads to less turbulence in the inlet region of the capillary. That the organization of the gas at the capillary inlet is important is shown in the following paper: "Improved Capillary Inlet Tube Interface for Mass Spectrometry—Aerodynamic Effects to Improve Ion Transmission", D. Prior et al., Computing and Information Sciences 1999 Annual Report. The authors report that a slight funnel-shaped widening of the capillary inlet leads to a fourfold increase in the transmission of ions from an electrospray ion source. These findings could not be confirmed by other working groups, possibly because more ideal conditions already prevailed in their initial set-up.

The gas load in the vacuum system of a mass spectrometer generally makes it necessary to have a differential pumping system with at least three pressure stages. Commercially available electrospray devices incorporate at least three, usually even four pressure stages. There are now four-stage turbomolecular pumps designed especially for these applications commercially available. In the first differential pumping stage there is a relatively high pressure, usually in the region of several hectopascals up to a maximum of several kilopascals; such a high pressure greatly impedes the onward transmission of the ions. The pressure in this differential pumping stage determines the upper limit for the inflow of gas and limits the dimensions of the inlet capillaries used.

As the gas flows out of the inlet capillary, a weakly focused gas jet forms in the first pump stage, said jet usually being directed at the small aperture to the next pump stage. Located around the aperture is a conical gas skimmer which repels the gas in the outer part of the gas jet toward the outside. The skimmer usually has an electric potential intended to guide the ions through the aperture. This results in high focusing and scattering losses, however.

A recent trend is to use RF ion funnels instead of the skimmers. Ion funnels consist of a series of diaphragms with round apertures whose diameters become progressively smaller so that a funnel-shaped space is created in the interior. The last diaphragm, with the smallest aperture diameter, usually represents the transition to the next vacuum chamber. The two phases of an RF voltage are applied in turn to the diaphragms, generating a pseudopotential which keeps the ions away from the diaphragm edges forming the wall of this funnel. A DC voltage superimposed on the diaphragms generates an axial DC field, which guides the ions to the exit of the funnel at the narrow end. The use of these funnels improves the ion transport through this first pressure stage, but is limited to pressures below a few kilopascals, preferably below a few hectopascals, because otherwise the pseudopotentials of the ion funnel are no longer able to repel the ions, on the one hand, and because the ions are transported in the direction opposing the pseudopotential viscously entrained by the gas emerging between the diaphragms, on the other hand. In the second pressure stage it is then possible to capture the ions effectively by using an ion guide made of a multipole arrangement with long pole rods, for example, or by employing a second ion funnel.

With the prior art it is only possible to transport a small proportion of the ions from a large ion cloud into the vacuum undamaged. However, it has so far proven impossible to find really consistent data on what percentage of the ions flowing into an inlet capillary pass through undamaged. Most sources give a figure in the single digit percentage range; maximum estimates are around 20 percent. There is much room for improvement here. Moreover, in conventional atmospheric pressure ion sources, only a small proportion of the ions generated are actually introduced into the inlet capillary by the gas; here, too, improvements are possible.

SUMMARY

The invention comprises the steps (a) transferring ion-charged gas from regions of higher pressure into regions of lower pressure by a nozzle which generates a supersonic gas jet in the region of lower pressure, (b) passing the supersonic gas jet across this lower pressure region through an aperture, adjusted to the cross-section of the supersonic gas jet, to enter a separate pump chamber, from which the gas can be pumped away by a suitable, relatively small pump at a restored higher pressure, and (c) extracting the ions from the supersonic gas jet in the region of low pressure by electric or magnet fields, and transferring the ions to their intended use, an ion analyzer, for example.

An optimal nozzle for this invention is a Laval nozzle, which produces a well directed supersonic gas jet, which can enter the separate pump chamber through a small aperture. A Laval nozzle is therefore preferably assumed below.

A pressure of five hectopascals at most should exist in the region of low pressure, preferably only one hectopascal or less, in order not to destroy the supersonic gas jet. It is advantageous to use an RF ion funnel to collect the ions extracted from the gas jet. Any solvate sheaths which may be present on the ion's surfaces can also be removed from the ions by the shaking effect of the RF ion funnel. This requires that pressure and temperature in this region of low pressure, and voltage and frequency of the ion funnel can be adjusted to achieve complete desolvation.

The methods and the devices provided by the invention make it possible to introduce much more ion-charged gas from an atmospheric pressure ion source into a first vacuum chamber of an ion user than is possible with a conventional inlet capillary, but without burdening this first vacuum chamber with the gas, because the gas is largely passed over into the separate pump chamber, from where it is pumped off. Furthermore, the gas can be introduced with far fewer ion losses than is the case when using the conventional inlet capillary because only very low ion losses occur in the Laval nozzle, presumably far less than ten percent. The ions which enter the first vacuum chamber with the gas jet can then be pushed out of the gas jet by voltages on an electrode arrangement or by a transverse magnetic field before being collected by an ion funnel, for example, and fed to the ion user. "Ion user" here can mean a mass spectrometer or an ion mobility spectrometer, and also any other instrument which operates with ions in a vacuum.

As shown in FIG. 3, Laval nozzles have a narrowest cross-section and then become wider. In the narrowest cross-section the gas assumes the local speed of sound. In the part where the cross-section increases, the gas flow accelerates to supersonic speed, contrary to Bernoulli's laws, which only apply to subsonic flows. Laval nozzles can be shaped in such a way that a specified gas inflow is achieved from atmospheric pressure, and that this gas stream forms a supersonic gas jet with parallel flow strings in a vacuum chamber at a specified pressure; this gas jet is at the same pressure as the vacuum chamber and has a very low temperature of only a few kelvin. With a well-designed Laval nozzle, a supersonic gas jet can be maintained which almost keeps its good parallel form, with all molecules having the same velocity, for a distance of ten centimeters and more. If the gas starts from atmospheric pressure with standard conditions, the velocity for air molecules in the supersonic gas jet amounts to around 790 meters per second.

The Laval nozzle can generate a far larger gas inflow than a conventional inlet capillary. A conventional inlet capillary with 0.5 millimeter internal diameter and 160 millimeters long introduces a maximum of around two liters of ambient gas per minute into the vacuum. The gas forms a diffuse gas jet at the end of the inlet capillary which burdens the first pressure stage to the full extent. The Laval nozzle, in contrast, can produce a well-directed supersonic gas jet from ten liters of gas per minute, for example, and after this jet has traversed a distance of five to ten centimeters, it passes through an aperture into the separate pump chamber, almost without burdening the first vacuum chamber. If the pressure in the supersonic gas jet is lower than in the surrounding vacuum chamber, it even acts as a pump and additionally pumps residual gas from the first vacuum chamber into the separate pump chamber. Only a small amount of gas which is stripped off the supersonic jet by friction with the residual gas, and a little gas which flows back from the separate pump chamber, burdens the first vacuum chamber of the differential pump system. The generally expensive differential pump system used here can therefore be much smaller than usual.

The pump for the separate pump chamber, in which a gas pressure of around a hundred hectopascals can be restored by refraction of the gas jet, can be a small rotary forepump, a small scroll pump, a diaphragm pump or even a water-jet pump, for example. The pressure is already too high for the turbomolecular pumps usually used in the differential pump system.

If the backflow of gas from the separate pump chamber into the first vacuum chamber is too high because, for example, the size of the aperture cannot be precisely adapted to the gas jet, a further pressure stage can be inserted by using an intermediate chamber. This means that the required capacity of the individual pumps can be kept lower still, and thus the whole pump system can be even smaller and less expensive.

Since the gas introduced through the Laval nozzle is pumped off almost completely at a separated location, one can falsely assume that this gas does not need to be as clean as the conventional curtain gas, which usually consists of high-purity nitrogen. However, in the Laval nozzle the gas introduced cools very rapidly; the temperature in the supersonic jet is only a few kelvin. Impurities may freeze out and form hard and sharp particles, milling the areas of impingement.

The almost complete elimination of ion losses in the Laval nozzle and the higher gas flow mean that around 10 to 50 times more ions can be introduced into the vacuum system of the ion spectrometer than before. This in turn increases the sensitivity of the mass spectrometer or ion mobility spectrometer correspondingly.

DETAILED DESCRIPTION

Figure 1:
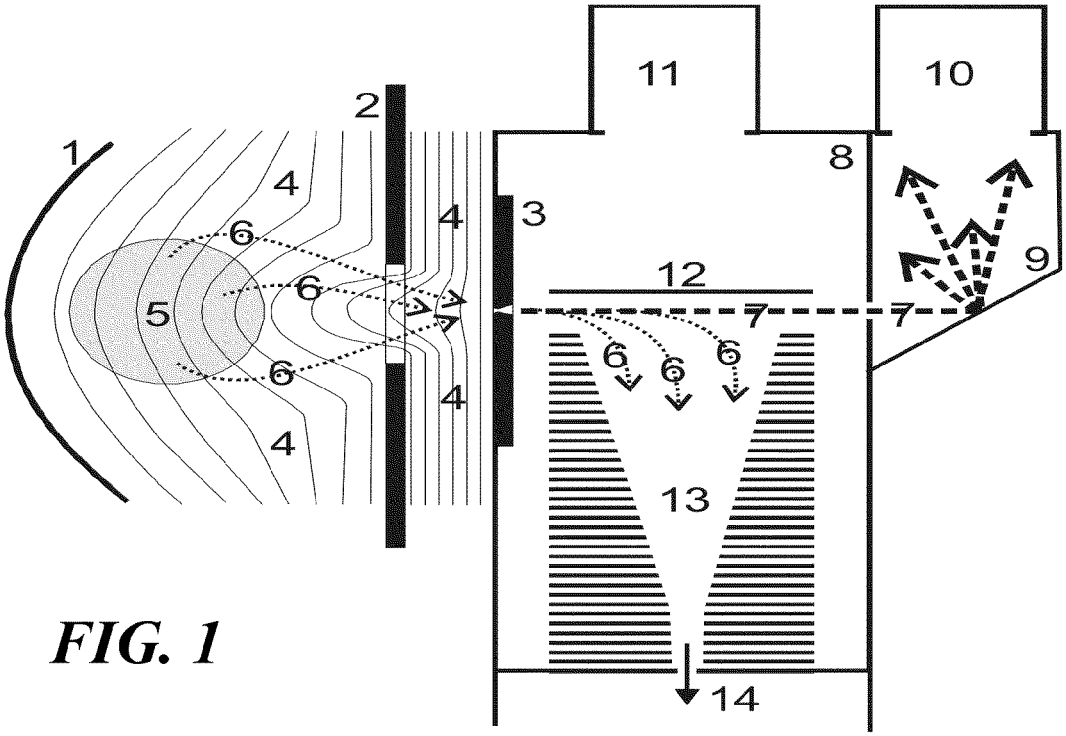
FIG. 1 is a schematic representation of an arrangement of an ion inlet system according to this invention. Voltages on the electrodes (1), (2) and the nozzle plate (3) generate a potential distribution (4) which causes the ions (6) from the ion cloud (5) to migrate to the Laval nozzle in the nozzle plate (3), assisted by the gas stream drawn in by the Laval nozzle. The Laval nozzle in the nozzle plate (3) produces a supersonic gas jet (7,) which is directed through the first vacuum chamber (8) into the pump chamber (9), where the gas of the supersonic gas jet is pumped off by pump (10). Voltages on the electrode (12) push the ions (6) out of the supersonic gas jet (7) and guide them into the RF ion funnel (13), which can transmit them in the form of an ion beam (14) to the ion spectrometer.

While the invention has been shown and described with reference to a number of embodiments thereof, it will be recognized by those skilled in the art that various changes in form and detail may be made herein without departing from the spirit and scope of the invention as defined by the appended claims.

The fundamental idea of the invention is to use a nozzle for the introduction of the ion-charged gas into a first vacuum chamber of a differential pump system, said nozzle producing a supersonic gas jet and having almost no ion losses. Particularly favorable here is a Laval nozzle, which generates a supersonic gas jet at very low temperature. To prevent the gas burdening the first vacuum chamber of the differential pump system, the supersonic gas jet is injected through the first vacuum chamber as unhindered as possible into a small aperture (whose size is adapted to the gas jet) of a separate pump chamber. In this separate pump chamber the cold supersonic gas jet impacts on a wall, which causes the gas to heat up and restore a higher gas pressure, which can easily be around fifty hectopascals or more, so the gas can be removed by a suitable, relatively small pump at this higher gas pressure. It is thus even possible to introduce far higher gas flows into the vacuum than is possible with conventional inlet capillaries without burdening the differential pump system. The ions are extracted from the supersonic gas jet in the first vacuum chamber by electric or magnetic fields of arbitrary shape; electric fields opposing the supersonic gas jet are also possible. The ions can be taken up by an RF ion funnel and introduced to the ion user, such as a mass spectrometer or an ion mobility spectrometer.

Laval nozzles can be dimensioned so that the gas inflow from atmospheric pressure into a vacuum is several times larger than the gas inflow through a conventional inlet capillary. A Laval nozzle of 0.4 to 0.6 millimeters narrowest diameter draws in between 2.3 and 5.6 liters of gas per minute and, if it has the right design, it produces a parallel supersonic gas jet which can be directed through a small aperture into the separate pump chamber so that its gas does not burden the first vacuum chamber.

The shape of a Laval nozzle can be optimized by a so-called "method of characteristics", which is often used for the graphic solution of systems of differential equations. The method is known in gas dynamics. The Laval nozzle is generally optimized to the ambient pressure as it leaves the Laval nozzle, the most favorable supersonic gas jet being generated when the pressure in the emerging supersonic gas jet is exactly equal to the ambient pressure. This condition is no longer so critical when exiting into vacua of around one hectopascal or lower, so it is possible to optimize to a fastest possible supersonic gas jet. Here it depends mainly on the dimension of the exit aperture (diameter c in FIG. 3) in relation to the dimension in the narrowest cross-section (diameter b in FIG. 3). From the flow density curve of the diagram in FIG. 4 it can be seen that, for an ambient pressure of one hectopascal, a diameter ratio c:b of around 4.5:1 is advantageous. For a Laval nozzle measuring 0.5 millimeters at the narrowest cross-section, which generates an inflow of around 3.7 liters per minute, an exit aperture of around 2.5 millimeters diameter is advantageous, producing a supersonic gas jet with a diameter of around 2.5 millimeters.

If a supersonic gas jet with almost maximum velocity is produced, the local pressure in the supersonic gas jet as it exits from the Laval nozzle is very low, and the supersonic gas jet can even act as an additional pump, operating in a similar way to a water jet pump. Only a small number of gas molecules which are stripped off the supersonic gas jet by collisions with the residual gas remain in the first vacuum chamber. The generally expensive differential pump system can therefore be much smaller than usual.

A small roughing pump, for example a diaphragm pump, can be used as the pump for the separate pump chamber, in which a significantly higher gas pressure is restored by refraction of the supersonic gas jet. Several types of pump can be used here. The suction power should be around five cubic meters per hour, the optimum suction power being around fifty hectopascals. Theoretically even a water-jet pump could be used here. The velocity of the molecules in the supersonic gas jet means it can enter the pump chamber against a pressure of around fifty hectopascals.

A favorable embodiment of the invention is shown in FIG. 1, in which ions from an ion cloud (5) are to be introduced into an ion spectrometer. The ions of the ion cloud (5) can have been produced by electrospray ionization (ESI) at atmospheric pressure, for example, and also by chemical ionization at atmospheric pressure (APCI) or photoionization at atmospheric pressure (APPI). All these ion sources are commercially available; these types of ion source are well-known to the person skilled in the art. Voltages on the electrodes (1), (2) and the nozzle plate (3) generate a potential distribution (4) around the ion cloud (5) which allows the ions (6) to migrate through the gas, by virtue of their mobility, to the Laval nozzle in the nozzle plate (3). This migration through the gas is assisted by the gas flow, drawn in conically by the Laval nozzle, which viscously entrains the ions (6). This gas flow ultimately drags the ions (6) into the entrance aperture of the Laval nozzle in the nozzle plate (3). The Laval nozzle in the nozzle plate (3) is shaped so that it produces a supersonic gas jet (7), which is here directed according to the invention through the first vacuum chamber (8) into the pump chamber (9). The supersonic gas jet is very cold; its temperature is only a few kelvin. In the pump chamber (9), the gas jet impacts on a surface, causing the gas to heat up, and is converted into a gas flow, slightly directed by reflection, at a higher pressure of around fifty hectopascals. This means that this gas stream can be pumped off using a relatively small forepump (10). In the first vacuum chamber (8), a voltage on the electrode (12) pushes the ions (6) out of the supersonic gas jet (7) and guides them into the RF ion funnel (13), which can transmit them as an ion beam (14) to the ion spectrometer.

Since there is a higher pressure in the pump chamber (9), a backflow of gas into the first vacuum chamber (8) can occur if the aperture between the two chambers is too large. If the aperture has the right size, and if the supersonic jet is accurately aligned, this backflow does not occur, but rather the supersonic jet may pump a little additional gas from the first vacuum chamber (8) into the pump chamber (9). If it is difficult to align the supersonic jet (7) accurately onto the aperture to the pump chamber (9), a slightly larger aperture must be selected so that a slight backflow of gas occurs, particularly if a higher pressure prevails in the pump chamber (9) because of a very small and low-cost pump.

Figure 2:
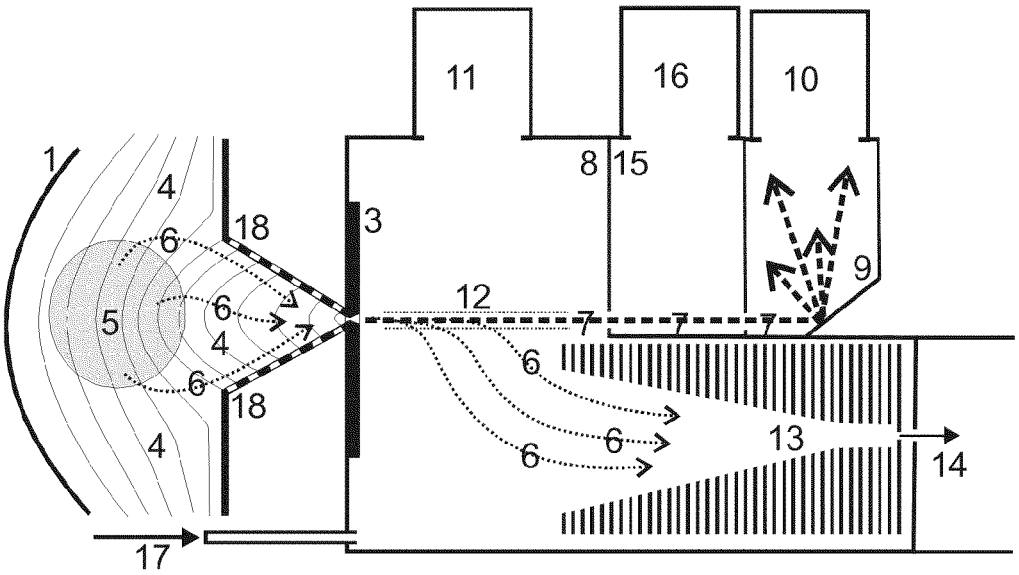
FIG. 2 shows an arrangement which has an additional intermediate chamber (15) with pump (16) in order to prevent excessive backflow of gas from the pump chamber (9) into the first vacuum chamber (8). Additionally, the electrode arrangement (12) here has the form of two grids arranged a short distance apart so that ions of very low mobility can also be removed from the gas jet (7) with moderate voltages. The ions here are taken up by an RF ion funnel (13), which is arranged parallel to the supersonic gas jet (7) in order to fit better with the design of existing instruments. The gas inlet (17) makes it possible to adjust the pressure in the first vacuum chamber (8) as desired in order to achieve optimum desolvation of the ions in the RF ion funnel, for example. A mechanically closed gas-tight DC funnel (18) made from insulated diaphragms with appropriate voltages is arranged in front of the Laval nozzle here, said funnel being able to draw in a large amount of gas and electrically focus the ions in the gas away from the funnel wall and direct them towards the input aperture of the Laval nozzle in the nozzle plate (3) by means of the potential distribution (4).

If the backflow of gas from the pump chamber (9) into the first vacuum chamber (8) is too high, an intermediate chamber (15) with its own pump (16) can be inserted here, as is outlined in the arrangement in FIG. 2. Although one extra pump (16) is used here, the required capacity of each pump can each be kept so low that a low-cost overall solution for the vacuum system of the spectrometer is created. The high-vacuum pumps (16) and (11) can be formed by two stages of a four-stage turbomolecular pump, for example, while the two remaining stages can be used for the subsequent vacuum system of an ion spectrometer.

FIG. 2 depicts an advantageous embodiment of the invention, which not only contains the intermediate chamber (15) as described above for reducing the backflow. In front of the Laval nozzle in the nozzle plate (3) this embodiment has a gas feeder funnel (18), which is connected to the Laval nozzle so as to be mechanically gas-tight with smooth flow properties, said funnel serving to draw in most of the gas of the ion cloud (5). To prevent the ions being lost by coming into contact with the wall of the gas feeder funnel (18), an appropriate voltage drop along the interior walls of the funnel is used to create a potential distribution (4) which makes the ions migrate in the moving gas away from the wall of the gas feeder funnel (18) and toward the inlet of the Laval nozzle. The voltage drop can be generated by constructing the gas feeder funnel (18) out of alternating layers of metal and insulating material with a corresponding voltage supply.

Instead of using a gas-tight gas feeder funnel (18), it is also possible to introduce clean curtain gas through openings in the wall of the gas funnel in order to hold back the gas of the ion cloud and replace it. Under the influence of the electric fields within the gas funnel, the ions then migrate into this curtain gas and are entrained by the curtain gas into the Laval nozzle.

The embodiment of FIG. 2 shows additionally that the RF ion funnel (13) can also be arranged parallel to the supersonic gas jet (7). This arrangement allows many commercial mass spectrometers to be equipped with this type of ion source without significant changes to the overall design.

The polar ions from electrospray ion sources are often still surrounded with a few polar molecules of the solvent, i.e. with solvate sheaths. It is assumed by some specialists in the field that the solvate sheaths are removed best in the inlet capillary by feeding in hot curtain gas, but this assumption is not safe. Some authors assume that the solvate sheaths are only removed in the ion funnel or in the impact cloud of the gas flowing from the inlet capillary into the first vacuum chamber. In any case, the ions cannot lose their solvate sheath, if one is present, in the cold supersonic gas jet; just the opposite, further molecules can easily attach here. This sheath of solvent molecules must be removed again. This can preferably occur in the RF ion funnel (13), where the ions are shaken in the residual gas by the RF field and thus are subject to many medium-strength collisions. As far as the desolvation is concerned, it is advantageous to be able to accurately set pressure and temperature of the residual gas in this first vacuum chamber (8), by controlling amount and temperature of the gas admitted by the gas feeder (17), for example. It is advantageous if the gas introduced through the supply capillary (17) can be heated. An ion funnel (13) which can be heated is also advantageous. Additionally, for a successful desolvation, it is advantageous to be able to set the frequency and amplitude of the RF voltage.

Figure 3:
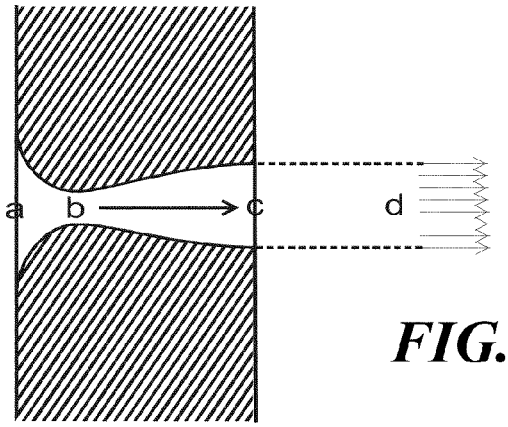
FIG. 3 depicts a Laval nozzle which has an advantageous shape for the outflow of the gas from atmospheric pressure into the vacuum. The gas flows in through the rounded aperture (a), reaches exactly the local speed of sound in the region (b) of the narrowest cross-section, is accelerated to supersonic speed in the region between (b) and (c), and exits the Laval nozzle at (c) as a strongly directed supersonic jet (d) with parallel flow threads of ions of the same velocity. The shape should be adjusted to the pressure in the vacuum chamber; an optimum shape can be calculated by a so-called method of characteristics.
Figure 4:
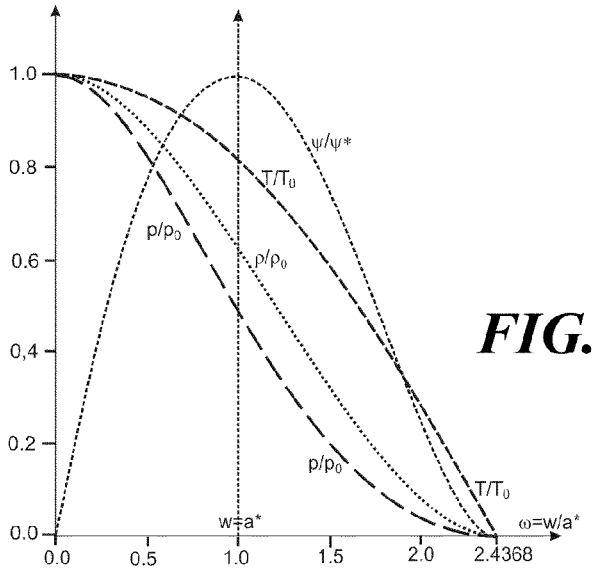
FIG. 4 shows the so-called "outflow diagram" for compressible gases (here for air) from a region with pressure $p_0$, density $\rho_0$ and temperature $T_0$. Local pressure $p/p_0$, local density $\rho/\rho_0$ and local temperature $T/T_0$ are plotted against the relative gas velocity $\omega$, the local gas velocity w being related to the local sound velocity a* in the narrowest cross-section of the nozzle ($\omega=w/a^*$). The curve of the flow density $\psi=\rho\times w$ is here related to the flow density $\omega^*$ in the narrowest cross-section. For the outflow of air into the vacuum, a maximum velocity $w_{max}=2.4368\times a^*$ results for the supersonic gas jet. For outflowing air under standard conditions (1,000 hectopascals, 20° Celsius) the maximum velocity of the molecules of the supersonic gas jet is 792 meters per second.

A favorable form of a Laval nozzle is shown in FIG. 3. The gas flowing in through the rounded aperture (a) reaches exactly the local speed of sound in the region (b) of the narrowest cross-section. This local speed of sound for air amounts to about 91 percent of the speed of sound under standard conditions. The gas is accelerated to supersonic speed in the region between (b) and (c), the maximum achievable supersonic speed for air being around 2.22 times the speed of sound under standard conditions (precisely 2.4368 times the local speed of sound in the narrowest part of the Laval nozzle). For air flowing out from the region with standard conditions the maximum speed amounts to 792 meters per second. The supersonic gas jet (d) exits at the end (c) of the Laval nozzle. Its diameter is determined by the exit aperture (c) of the Laval nozzle, but this cannot be chosen arbitrarily; it results from the optimization calculation.

In the supersonic gas jet (7) with low temperature and low pressure, the ions have an extraordinarily high mobility. If the ion density is high, most ions will leave the jet without any help just by the effects from space charge; it is only at low space charge density that the ions are entrained in the supersonic jet of gas. The flight path through the vacuum chamber (8) should not amount to more than around five to ten centimeters. The time of flight through a vacuum chamber (8) eight centimeters in length at a velocity of almost 800 meters per second is only around a hundred microseconds. The high mobility of the ions means they can easily be extracted from the supersonic jet by an electric field within this time of flight, even if the migration path across the supersonic jet amounts to two or three millimeters. In order to extract all the ions from the supersonic gas jet, the arrangement shown in FIG. 2 has a slightly different design of electrode system (12) for removing the ions from the supersonic gas jet than the one FIG. 1. The electrode system (12) here consists of two fine grids at a separation of only about five millimeters, between which the supersonic gas jet is located. The length of the supersonic gas jet between the grids is around five centimeters. A voltage difference of a few volts here can produce a field strength which is sufficient to also extract ions of even very low mobility from the supersonic jet. The low voltages mean the ions cannot gain any kinetic energy here for a fragmentation.

Figure 5:
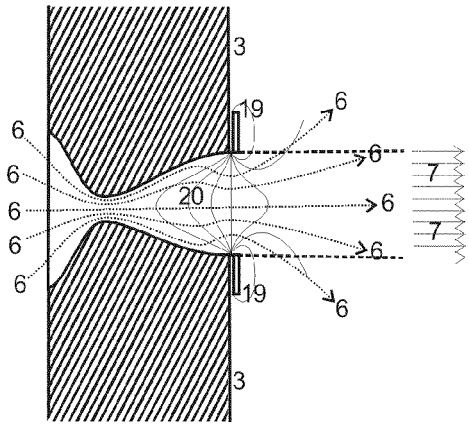
FIG. 5 shows how the paths of the ions (6) can be focused within the Laval nozzle by the potential distribution (20) of a voltage at a diaphragm (19) in such a way that they do not impact on the inner wall of the Laval nozzle even when they repel each other by their space charge, but only leave the supersonic gas jet (7) outside the Laval nozzle. In the exit region of the Laval nozzle, the mobilities of the ions become so high, due to the low local pressure and the low local temperature, that the ions can be pushed to the nozzle walls by mutual Coulomb repulsion, although they only spend a few microseconds here.
Figure 6:
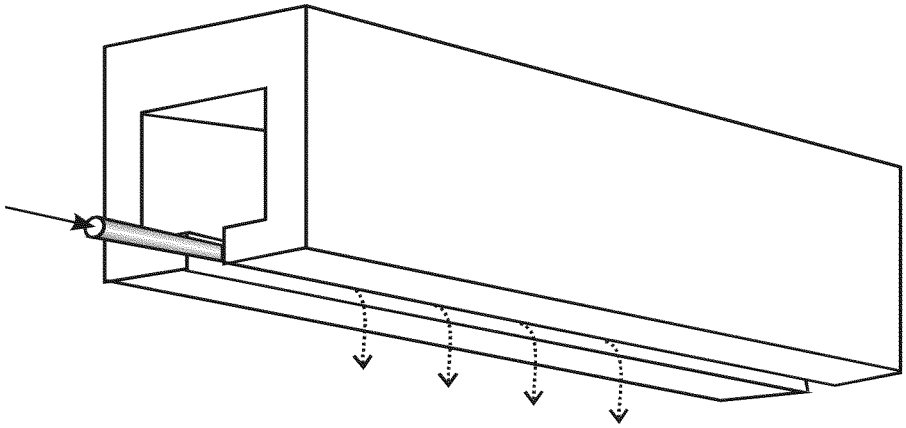
FIG. 6 shows the expulsion of the ions from the supersonic gas jet by a transverse magnetic field.

A high density of ions in the gas creates repulsive Coulomb forces which expel the ions of high mobility automatically from the supersonic gas jet. The ions already achieve high mobility in the Laval nozzle close to the exit aperture. In order to prevent the ions impacting here on the inner wall of the Laval nozzle, it is possible to generate a potential distribution which largely prevents these collisions. FIG. 5 shows how an external annular electrode (19), to which an ion-attracting potential is applied, can be used to generate a potential distribution (20) in the interior of the Laval nozzle, which focuses the ions on their ion paths (6) into the center of the supersonic gas jet (7). The ions only exit the supersonic gas jet outside the Laval nozzle. They can be captured by electrode arrangements here and guided to the RF ion funnel (13).

Since the gas introduced through the Laval nozzle is pumped off almost completely at a separated location, one can falsely assume that this gas does not need to be as clean as the conventional curtain gas, which usually consists of high-purity nitrogen. However, in the Laval nozzle the gas introduced cools very rapidly; the temperature in the supersonic jet is only a few kelvin. Impurities may freeze out and form hard and sharp particles, milling and grinding the areas of impingement. Particularly residues of solvents, from the electrospraying, for example, may be detrimental.

The technology to date uses inlet capillaries which heavily burden the first vacuum chamber with gas. In order to keep the vacuum chamber clean, the mixture of air, solvent vapors and ions from the ion cloud produced in vacuum-external ion sources is usually not introduced into the vacuum directly. Instead, a very clean curtain gas is fed in close to the entrance aperture of the inlet capillary. Furthermore, this gas can be suitably heated and its moisture content controlled. Such a curtain gas can, of course, also be used in arrangements according to this invention, in an arrangement as shown in FIG. 1, for example. The ions are then transferred out of the originating cloud (5), by means of electric potential distributions (4), into the curtain gas flowing between the electrode (2) and the nozzle plate (3), and are drawn with it into the inlet capillary.

The introduction of ions into the vacuum is necessary because it is becoming more and more common to generate the ions at atmospheric pressure. One such ion source is the electrospray ion source (ESI), but other ionization methods such as photoionization (APPI) or chemical ionization at atmospheric pressure (APCI) with initial ionization by corona discharges or beta emitters (for example by $^{63}$Ni) must be listed here. Similarly, ionization by matrix-assisted laser desorption (MALDI), with or without further ionization aids, can be conducted at atmospheric pressure (AP-MALDI). All these ion sources generate clouds of ions in ambient gas outside the vacuum system. A relatively new type of ionization has become known as laser ionization at atmospheric pressure (APLI). This is usually a two-photon ionization with the aid of a pulsed UV-laser, which is mainly used for the ionization of aromatic compounds which cannot be ionized by electrospray ionization.

Figure 7:
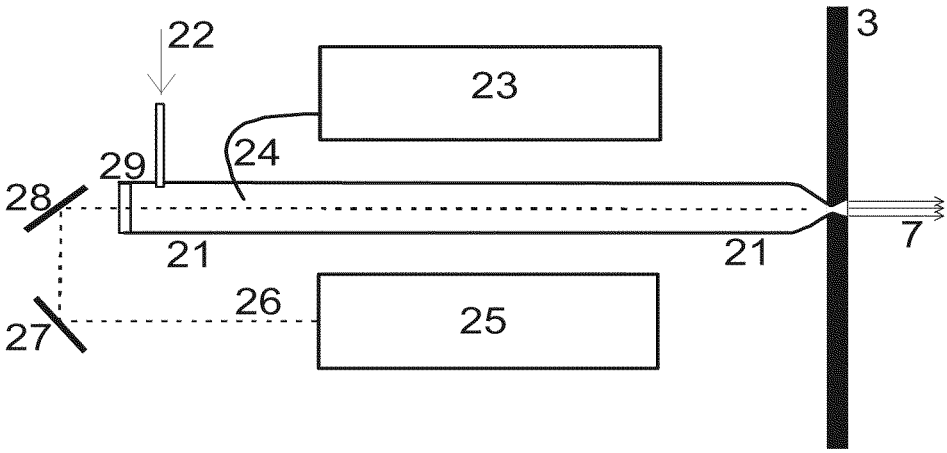
FIG. 7 illustrates ion generation by laser ionization at atmospheric pressure (APLI) in a special reaction tube (21). The reaction tube here (21) is connected to the Laval nozzle in the nozzle plate (3) so as to be gas-tight with smooth flow properties. The Laval nozzle generates the supersonic gas jet (7) in the first vacuum chamber. The pressure in the reaction tube (21) is kept at standard pressure by the gas feeder (22). A temporally separated mixture of substances which are to be ionized is introduced from a gas chromatograph (23) through an exit capillary (24). The pulsed UV laser (25) generates a pulsed laser beam (26), which is guided by the mirrors (27) and (28) through the window (29) into the reaction tube, where it ionizes the substances with high yield by multiphoton ionization. The ions are entrained in the gas and introduced through the Laval nozzle to an ion spectrometer (not shown) with only minor losses. This arrangement provides an extremely high degree of sensitivity for substances which can be ionized by this multiphoton ionization, such as aromatic substances.

FIG. 7 illustrates ion generation by this UV laser ionization at atmospheric pressure (APLI), performed not in a conventional open arrangement but in a special long reaction tube (21). The reaction tube (21) here is connected to the Laval nozzle in the nozzle plate (3) so as to be gas-tight with smooth flow properties. In the first vacuum chamber, the Laval nozzle produces the familiar supersonic gas jet (7). The pressure in the reaction tube (21) is kept at standard pressure by the gas feeder (22); the easiest way to achieve this is for the gas drawn off through the Laval nozzle to simply replenish itself. It is best to use clean nitrogen here. A temporally separated mixture of aromatic substances from a gas chromatograph (23) is introduced in a small helium gas flow via the exit capillary (24). These substances are to be ionized. The pulsed UV laser (25), for example a Nd:YAG laser with energy quadrupling, generates a pulsed laser beam (26), which is guided by the mirrors (27) and (28) through the window (29) and into the reaction tube, where it ionizes the aromatic substances with a high yield. The ions are guided in the gas with only minor losses through the Laval nozzle into the first vacuum chamber of an ion spectrometer (not shown).

The reaction tube (21) can be used not only for laser ionization but also for chemical ionization, by allowing reactant ions from suitable ion sources enter into the reaction tube (21) with the gas introduced through the feed (22).

It will be easy for the mass spectrometric specialist with knowledge of this invention to connect further types of atmospheric pressure ion sources to the Laval nozzle in an advantageous way and thus achieve a low-loss transfer of the ions into the vacuum.

The invention can be used not only with mass spectrometers where ions are generated outside the vacuum but also for all other types of device which use ions in a vacuum, such as ion mobility spectrometers. Even within ion spectrometric vacuum systems, ions can be transferred in this way from one vacuum chamber into others.

The term "atmospheric pressure" should not be interpreted too narrowly here. In an extended sense it is to be understood here as meaning any pressure which brings about a viscous entrainment of the ions, i.e. any pressure above approximately one hundred hectopascals in any case. In this pressure range, the normal laws of gas dynamics apply and the viscous entrainment of ions predominates.

The almost complete elimination of ion losses and the higher gas flow mean that around 10 to 50 times more ions can be introduced into the vacuum system of the ion spectrometer than before. This in turn increases the sensitivity of the ion spectrometer correspondingly.

What is claimed is:

1. A method for the transfer of ions contained in a gas from a first region containing gas having a first pressure into a second region containing gas having a second pressure lower than the first pressure, comprising (a) accelerating the gas with the ions between the first and the second regions by a nozzle to form a supersonic gas jet;

(b) extracting ions from the supersonic gas jet in the second region in a direction substantially perpendicular to an axis of propagation of the supersonic gas jet by using electric or magnetic fields and;

(c) directing the supersonic gas jet devoid of the extracted ions through the second region into a separate pump chamber in which the gas of the supersonic gas jet is pumped off; and (d) transferring the extracted ions to an ion analyzer for analyzing the extracted ions.

2. The method of claim 1, wherein the nozzle is a Laval nozzle.

3. The method of claim 1, further comprising collecting ions of extracted from the gas jet in the second region by an RF ion funnel and transmitting the collected ions of interest as an ion beam.

4. The method of claim 3, wherein parameters of the ion funnel are adjusted so that a desolvation of the collected ions occurs due to collisions of the ions with gas molecules.

5. The method of claim 4, wherein pressure and temperature parameters of the gas in the RF ion funnel are adjusted so that a desolvation of the collected ions occurs.

6. The method of claim 4, wherein an RF voltage is applied to the RF ion funnel and a frequency and amplitude of the RF voltage are adjusted so that a desolvation occurs.

7. The method of claim 1, wherein the ions in the gas in the first region form an ion cloud and the method further comprises guiding the ions from the ion cloud to the nozzle by one of gas flow and ion migration in an electric potential distribution.

8. An ion spectrometer, comprising:

a device for the generation of ions in a gas in a region containing gas at a first pressure;

a chamber containing gas at a second pressure that is lower than the first pressure;

a nozzle connecting the region to the chamber, which nozzle is shaped so that a supersonic gas jet is generated by gas and ions passing through the nozzle from the region into the chamber, the supersonic gas jet passing through the chamber;

an extraction structure that extracts ions from the supersonic gas jet in the chamber in a direction substantially perpendicular to an axis of propagation of the supersonic gas jet, collects the extracted ions and guides the collected ions to an ion analyzer; and a pump chamber located adjacent to the chamber, into which the supersonic gas jet devoid of the extracted ions enters through an aperture, and from which the gas of the supersonic gas jet is pumped off.

9. The ion spectrometer of claim 8, wherein the nozzle has a shape of a Laval nozzle.

10. The ion spectrometer of claim 8, wherein the extraction structure comprises an ion funnel located in the chamber that collects ions extracted from the supersonic jet and transmits the collected ions to the ion analyzer.

11. The ion spectrometer of claim 8, comprising one of an elongated reaction tube and a gas feeder funnel located in the region and connected with a gas-tight connection to the nozzle.

12. The ion spectrometer of claim 8, wherein the ion analyzer is one of a mass spectrometer and an ion mobility spectrometer.

* * * * *